United States Patent [19]

Kleist et al.

[11] 4,033,255

[45] July 5, 1977

[54] PRINT HAMMER ACTUATOR FOR DOT MATRIX PRINTERS

[75] Inventors: Robert A. Kleist, Anaheim; Jerry Matula, Culver City, both of Calif.

[73] Assignee: Printronix, Inc., Irvine, Calif.

[22] Filed: Nov. 13, 1975

[21] Appl. No.: 631,449

[52] U.S. Cl. ..... 101/93.04; 197/1 R; 335/300

[51] Int. Cl.[2] ..... B41J 7/70

[58] Field of Search ..... 101/93.09, 93.04, 93.05, 101/93.48; 197/1 R; 335/300; 174/15 R, 16 R; 165/185, DIG. 3; 336/61

[56] References Cited

UNITED STATES PATENTS

| | | | |
|---|---|---|---|
| 2,528,734 | 11/1950 | Brass | 335/300 X |
| 2,947,957 | 8/1960 | Spindler | 336/61 |
| 3,317,798 | 5/1967 | Chu et al. | 165/DIG. 3 |
| 3,541,435 | 11/1970 | Davis | 336/61 X |
| 3,659,238 | 4/1972 | Griffing | 335/229 |
| 3,782,278 | 1/1974 | Barnett et al. | 101/93.04 |
| 3,818,398 | 6/1974 | Barbier et al. | 336/61 X |

*Primary Examiner*—Edward M. Coren

*Attorney, Agent, or Firm*—Fraser and Bogucki

[57] ABSTRACT

An improved print hammer actuator for dot matrix printers employs a substantially closed loop magnetic path including a resilient magnetic hammer, a number of such hammers being aligned in a hammer bank assembly which is shuttled back and forth along a printing line at a high rate of speed, while the hammers are individually actuated by energizing coils which overcome a permanent magnetic field normally maintaining the hammers in retracted position. Heat conducting elements are mounted in heat transfer relationship with each of the different ones of the coils in the hammer bank, and high surface area fins on the elements extend into an air flow directed across one side of the hammer bank. For this purpose the hammer bank assembly is configured to define an interior air channel along its length and includes a fixed top cover and spaced apart circuit board forming part of a plenum and directing air frontwardly from a rear mounted fan. Heat generated in the coils during high duty cycle energization is effectively dissipated into the environment with substantial improvements in the uniformity of printer operation.

9 Claims, 4 Drawing Figures

PRINT HAMMER ACTUATOR FOR DOT MATRIX PRINTERS

BACKGROUND OF THE INVENTION

This invention relates to dot matrix printer systems, and more particularly to dot matrix printers employing a reciprocating hammer bank mechanism.

In a copending application for patent, Ser. No. 495,830, filed Aug. 8, 1974 for "PRINTER SYSTEM" by Gordon B. Barrus et al, assigned to the assignee of the present application, there is described an advantageous line printer for data processing applications utilizing a reciprocating hammer bank in which a plurality of individual hammers are mounted adjacent a printing line. Each of the hammer elements comprises a resilient magnetic strip which is normally retracted from the printing position by a substantially closed magnetic actuator circuit in which a common permanent magnet and a common return path are used. Generation of a compensating magnetic field by energization of a coil disposed adjacent the free end of the hammer in the magnetic circuit overcomes the magnetic bias and permits the hammer to fly forward to the impact point. This arrangement provides a compact and rugged high speed printer structure having particular ease of fabrication, assembly and maintenance.

When it is desired that a shuttling hammer bank of this type be operated in certain modes, substantial energizing loads are imposed on the energizing coils. As pointed out in the copending application, this type of printer has a capability for virtually arbitrary pattern generation, in that actuation of every possible printing position makes it possible to print an "all black" page or pattern, while graphs, bar charts and arbitrary characters can also be prepared. The magnetic elements of the desired hammer bank are substantially enclosed by front, top and rear covers which provide a compact dust and particle protective enclosure. However, under high duty cycle operation there is substantial internal heat build up due to coil heating under high current loads. Excessive heat build up tends to introduce a slight but significant warping of the backplate, which in practice moves the hammer elements 5–6 mils away from the printing position, and causes a lightening of the dot pattern. Similarly, heating of the coil reduces the intensity of cancelling magneto-motive flux in the magnetic circuit, thus lowering the impact force of the hammer against the paper and resulting both in lightening of the dot pattern and an increase of the flight time of the hammer, introducing an imprecision in dot placement. These effects, individually and cumulatively, tend to limit some of the advantages otherwise afforded by this new dot matrix printing system. It is not economically desirable, however, to provide localized refrigeration within the substantially enclosed hammer bank assembly. Addition of high mass structures to the hammer bank assembly would adversely affect the high speed shuttle motion, and increasing the power capability of the energizing circuits would increase both mass and cost. It is therefore desirable to reduce the heating problems engendered by high power consumption without otherwise affecting the mechanical and magnetic operation of the hammer bank.

SUMMARY OF THE INVENTION

An improved hammer bank system in accordance with the invention employs a heat transfer structure directly coupled to a series of energizing coils, and a tangential air circulation flow relative to the hammer bank structure and across the heat transfer structure. The disposition and configuration of the heat transfer structure in combination with air movement caused by the shuttle motion as well as the tangential flow provides highly effective dissipation of the heat generated at the coils.

In a specific example of a hammer bank system in accordance with the invention, heat conductive elements are disposed on each of a row of energizing coils. The heat conductive elements each include a set of planar surfaces disposed normal to the direction of reciprocation of the hammer bank, and parallel to an air flow directed from the rear of the hammer bank toward the shuttle position. Each heat conductive element has multiple fins extending from a concave bottom surface mounted in heat transfer relation to the top of the associated actuating coil. The fins thus extend upwardly in parallel relation, and with their broad faces substantially normal to the direction of reciprocation of the hammer bank. Air is directed across the fins from the rear of the hammer bank parallel to their broad faces by a rear-mounted blower. A plenum is provided between the hammer bank and the blower to equalize the air pressure along the inlet slot. The air flow along an open channel within the hammer bank and is confined by a stationary top cover spaced apart from the hammer bank. The heat exchange elements preferably have three spaced-apart fins each, terminating in free upper ends, and include apertures in their base portions which may receive protruding pins on the hammer bank mechanism. Advantageously, the heat transfer surfaces presented by the heat exchange elements, which have at least twice the surface radiating area of the energizing coils, are disposed in front of the air flow channel. With this combination, the hammer mechanisms can operate under substantial higher duty cycles than formerly with improved dot uniformity along the row of hammers, and with precise dot placement.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

A print hammer actuator for dot matrix printers in accordance with the invention may be utilized in a variety of contexts. These include use with an individual print element, use with a group of elements intended for concurrently printing one column in a dot matrix pattern, and use with a group of print elements disposed to reciprocate along a printing line. The last context is the most demanding, and is that described in referenced application Ser. No. 495,380. The present invention is shown and explained in such context, but it will be understood to be applicable to other structures as well. In this system, the hammer actuators and associated printing elements are arranged together in a hammer bank that is shuttled transversely while the hammer actuators are impulsed at different positions in each direction of movement to print at each of a number of character positions. Inasmuch as reference may be made to such application, the details of paper feed, hammer control and mechanism operation need not be described in detail herein in the interest of brevity and the description will be confined to those portions of the system dealing with the hammer bank and the different aspects of the present invention.

Figures 1, 4:
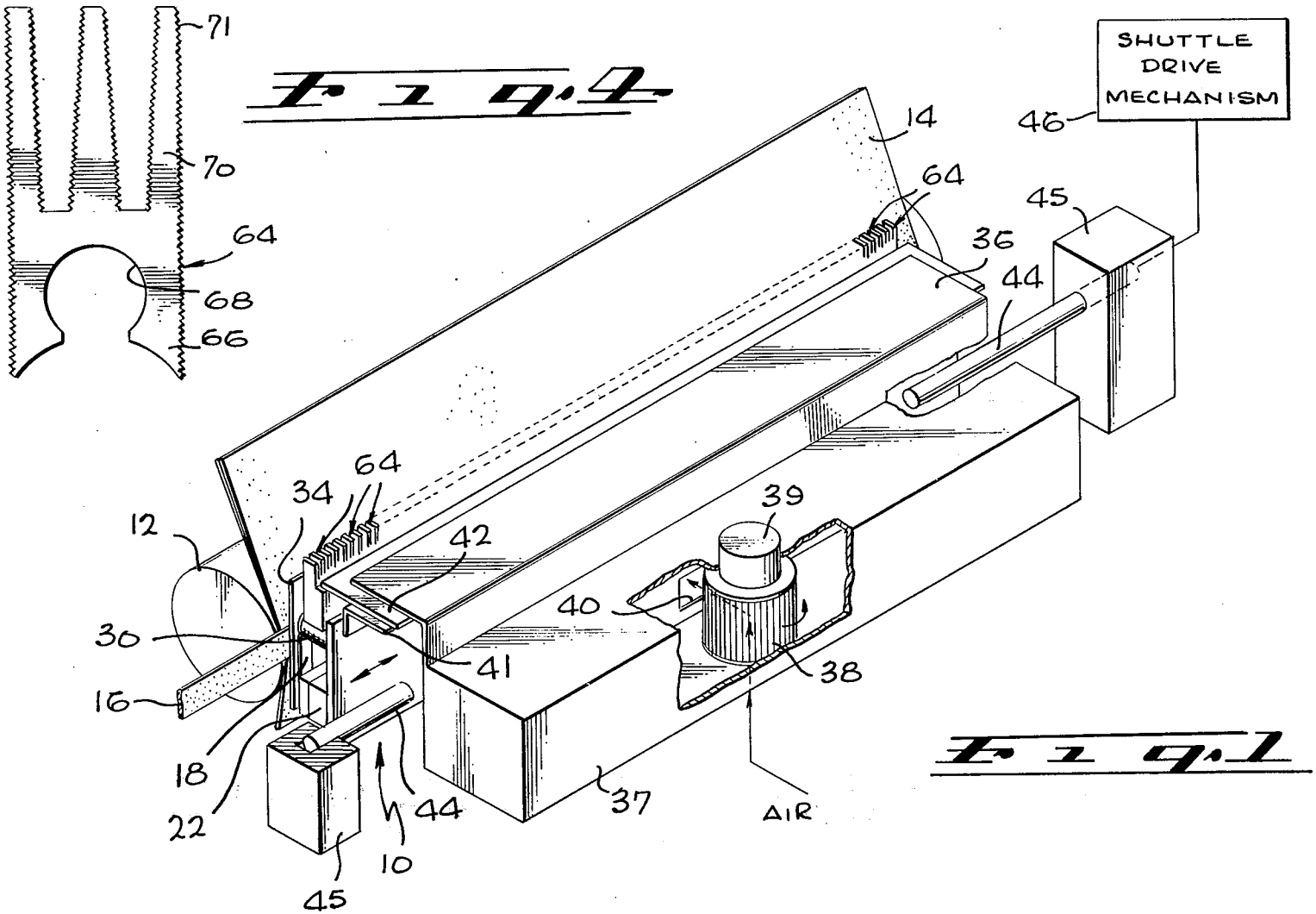
FIG. 1 is a combined block diagram and perspective view in somewhat simplified form of a part of a dot matrix printer mechanism in accordance with the invention.
FIG. 4 is an enlarged front view of a heat transfer element employed in the arrangement of FIGS. 1–3.

As best seen in FIG. 1, a reciprocating hammer bank 10 is disposed on the opposite side of a cylindrical printing platen 12 from a record medium or paper 14 comprising a single sheet or a plurality of sheets which are to be imprinted upon. A printing ribbon 16 is disposed along the hammer bank 10 between the record medium 14 and printing elements (shown in more detail in other Figures) on the hammer bank 10. A plurality of elongated print hammers 18 are disposed successively along the length of the hammer bank 10, and are mounted in generally vertical relation to a horizontal printing line extending along the printing ribbon 16. The usual horizontal printing disposition will be assumed herein for ease of understanding, although it will be recognized that the printer can be disposed in different attitudes.

Figure 2:
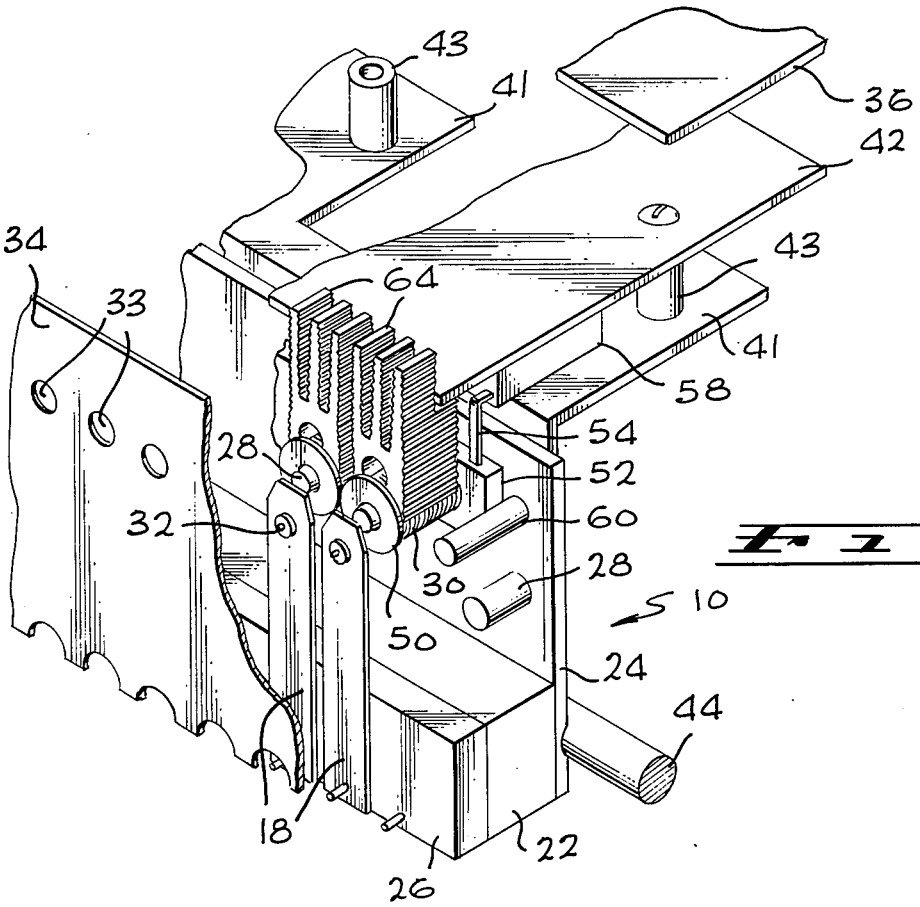
FIG. 2 is a fragmentary perspective view of a portion of the arrangement of FIG. 1, showing further details as to the hammer bank thereof in enlarged form.
Figure 3:
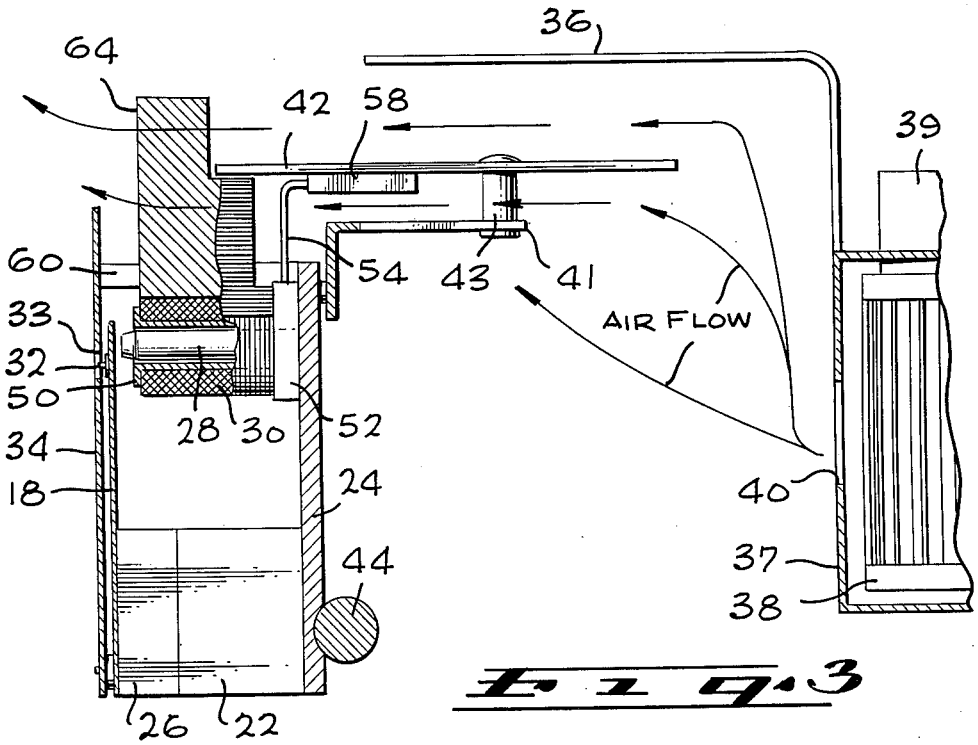
FIG. 3 is an end sectional view of a portion of the hammer bank of FIGS. 1 and 2.

The hammer bank 10 is also seen in FIGS. 2 and 3 and comprises an addition to the print hammers 18 a substantially enclosed magnetic assembly for individual energization of the print hammers 18. The magnetic assembly forms a generally C-shaped magnetic path and includes a unitary permanent magnet 22, a magnetic back plate 24 and a plurality of horizontally disposed magnetic pole pieces 28 spaced at equal increments along the printing line and extending forwardly from the back plate 24. The opposite ends of the C-shaped magnetic path abut the respective upper and lower ends of the print hammers 18, with the hammers 18 being coupled to the magnet 22 at an interposed magnetic insert 26, and being adjacent to the associated pole piece 28 at their upper ends. Each of a plurality of individual energizing coils 30 is disposed about a different pole piece 28. The print hammers 18 are resilient magnetic elements whose upper ends are normally bent inwardly against the adjacent pole piece 28 by the field of the permanent magnet 22 in the absence of an energizing coil signal. When an energizing signal is applied to the associated coil 30, however, the permanent magnet field is momentarily overcome in the region of the free end of the hammer 18 and the spring characteristic of the print hammer 18 causes it to fly outwardly toward the impact position on the paper 14. A print wire 32 protruding from the free end of the print hammer 18 then impacts on the ribbon 16 and paper 14 through an aligned aperture 33 in a front plate 34. The motion of the hammer 18 is of limited distance and very short duration, and the impact is effected with controlled momentum under normal conditions of operation.

Under high duty cycle conditions, however, the rapid impulsing of the coils 30 over a sustained duration causes substantial resistive heating. This heating both decreases the strength of the neutralizing electromagnetic field and increases the cycle time because of reduction in the energizing current. Consequently, there can be a marked reduction in the printing density as the hammers impact with less force — this loss of density is best seen as a substantial loss of blackness when the hammers are caused to print a solid black pattern. The increase in cycle time also results in misregistration of print dots in the matrix patterns because the shuttle motion is continuous. It is not feasible for reasons of mass, cost and complexity to surmount these problems by providing excess energy capability in the energizing circuits or by using electronic compensation techniques. In addition, the back plate 24 concurrently becomes heated and undergoes differential expansion relative to the hammer bank 10 structure. A small but significant outward displacement of 5 to 6 mils in the center of the back plate 24 thus increases the flight distance of the print hammers 18 and also contributes to loss of print density.

Referring again to FIG. 1 as well as FIGS. 2 and 3, a stationary L-shaped top plate 36 extends over the rearward portion of the hammer bank 10 from a stationary rear mounted fixed housing 37. The principal plane of the top plate 36 is horizontal and spaced apart above the hammer bank 10, and a depending leg is affixed to the rear housing 37, which contains a centrifugal air blower 38 driven by a motor 39. The blower 38 takes in air from the bottom of the housing 37 and directs it forwardly toward the hammer bank 10 under the top plate 36 through a side wall aperture 40. A horizontal plenum extending over the top of the back plate 24 is defined by the top cover 36 and a horizontal circuit board 42 disposed transverse to and above the top of the back plate 24. The circuit board 42 is supported on horizontally extending tabs 41 coupled to the back plate 24 by insulating washers 43. As seen in FIG. 3, initially horizontal air flow from the blower 38 is directed transversely to the top of the shuttle mechanism 10 and in a plane normal to the direction of shuttle motion on both sides of the circuit board 42. The plenum is enclosed at the ends, bottom and front by the printer casting, end blocks, and ribbon cover, which have been omitted for clarity. Alternatively, the plenum can be enclosed except for the air channel by simple panel members.

The body of the hammer bank 10 is supported on end shafts 44 resting in longitudinal slide bearings 45, with one of the end shafts being coupled to a reciprocable drive 46 which provides the desired shuttle motion for the hammer bank 10 in accordance with the teachings of Ser. No. 495,830.

Referring again to FIGS. 2 and 3, for ease of manufacturing and assembly, the energizing coils 30 are configured as a bobbin 50 which slides onto the associated pole piece 28. Electrical connections to the terminals of the coil 30 are made through a base 52 from which pins 54 extend upwardly to be received within pin connectors 58 disposed along the under side of the circuit board 42. The circuit patterns on the board 42 have not been shown for simplicity. The assembly also includes a number of positioning pins 60 extending from the back plate 24 along a line just above individual spaced apart ones of the bobbins 50, and engaging the back side of the front plate 34 to hold the proper spacing.

In combination with this arrangement, a number of individual heat exchange elements 64 are utilized, each disposed in heat transfer relationship with a different one of the energizing coils 30 on the bobbins 50. As also seen in FIG. 4, the heat exchange elements 64 are of heat conductive material, specifically aluminum in this example, and include a base portion 66 with a concave hemispherical base portion configured to register with the periphery of an energizing coil. The base portion also includes a cylindrical aperture 68 disposed to fit over a positioning pin 60 when one is disposed at that location. The base portion 66 of the heat exchange elements 64 adjoins vertically upstanding fins 70, here a set of three slightly tapered and spaced apart fins integral with the base. The broad surfaces of the fins 70 are parallel, open at the top, and in alignment with the rear to front direction of the hammer bank 10. Serrations 71 in the side surfaces of the fins 70 are employed to increase the effective surface area. This arrangement may advantageously be extruded as a single piece and then segmented into individual lengths. A shoulder 72 is provided in the rear portion of the fins 70 to provide registration with the abutting edge of the circuit board 42.

The heat exchange elements 64 are secured to the outer periphery of the associated energizing coil 38 by a heat conductive coupling, for which purpose a layer of epoxy resin (not shown) has been found advantageous. A suitable epoxy is sold under the trade name "8-2" by ABLE-STIK Adhesive Co. of Gradena, California. The added mass of the heat exchange elements 64 coupled to the coils 30 is relatively small but the coils may be secured to their associated bobbins 50, as by a synthetic resin adhesive, to prevent twisting under the reciprocating motion.

The heat exchange elements 64 are advantageously provided with three upstanding fins 70 for this application. The total surface area is preferably in excess of two times the radiating surface area of the associated energizing coil 30, and more precisely 2.8 times in the present example. It is found that a lesser number of fins does not provide adequate surface area, and that a greater number of fins gives substantially no better results. The open upper ends of the finned structure provide better heat dissipation than an enclosed structure of comparable surface area.

With the hammer bank 10 being reciprocated at high speed, such as at a rate of 1200 cycles per minute, air turbulence is constantly generated by the lateral motion along the horizontal printing line position. At the same time, air is blown across the broad faces of the fins 70 in the rear to front direction relative to the hammer bank 10. Air flow from the blower 38 is confined by the adjacent plenum and air pressure is equalized along the length of the inlet slot extending along the line of heat exchange elements 64. The flow passes on both sides of the circuit board 42. The protruding fins 70 of the heat exchange elements 64 are subjected to air circulation from both sources of motion, and because of their thermal coupling to the coils provide an excellent heat transfer mechanism. Thus heat generated within the coils 30, which are within the interior of the hammer bank 10, is constantly transported to and dissipated outside the hammer bank structure without the need for further special cooling, refrigeration or system redesign.

This arrangement has provided significant improvements in printing uniformity in structures in accordance with the invention, in comparison to previous structures. In measuring coil temperatures by thermocouples mounted on the hammer bank, it was found that the average temperature rise, above the ambient temperature, for an all black printing or other high duty cycle operation, was approximately 112° C. In contrast, using an arrangement in accordance with the invention employing horizontal and frontward air flows across heat exchange elements, a temperature rise of only 57° C. is encountered with high thermal conductivity epoxy. With a standard epoxy, the rise is limited to 66° C. The warping effect of the hammer bank is substantially decreased, inasmuch as temperature measurements indicate a reduction of a differential temperature of 44° above ambient to approximately 15° C. above ambient at the back plate. In addition, measurements of the warping of the hammer bank structure indicate a reduction in the maximum displacement of from 5 to 6 mils down to approximately 2 mils maximum. These effects are most readily apparent in printed output because contrasts within an all black printing pattern can readily be perceived. In structures in accordance with the invention, for example, continuous printing of an all black pattern for 15 minutes or more (a condition of usage which is many orders of magnitude more severe than would be encountered in actual practice) results in no discernible lightening of the printing pattern. Similarly, other stringent requirements, such as the repetitive printing of the letter "E" cause no discernible decrease in the degree of blackness.

While various modifications and alternative forms have been suggested, it will be appreciated that the invention is not limited thereto but encompasses all forms and variations within the scope of the appended claims.

What is claimed is:

1. An actuator system for a dot matrix printer having a plurality of hammer elements disposed along a printing line position and comprising:

a plurality of energizing coils disposed along the printing line position and each in operative relation to a different hammer element;

a plurality of heat conductive elements, each coupled in thermally conductive relationship to a different one of said energizing coils and having a plurality of spaced-apart fins, the fins of the heat conductive elements lying in a common plane;

means for moving the energizing coils and the heat conductive elements along the printing line position;

means for directing an air flow onto the heat conductive elements in a direction generally normal to the common plane; and means responsive to movement of the energizing coils and the heat conductive elements along the print line for directing a second air flow onto the heat conductive elements in a direction generally parallel to the common plane.

2. An actuator system for a dot matrix printer having a plurality of hammer elements disposed along a printing line position and comprising:

a reciprocating hammer bank mechanism having a substantially enclosed magnetic path for said hammer elements;

a plurality of energizing coils disposed along the printing line position, the coils being disposed in the substantially enclosed magnetic path for said hammer elements with each in operative relation to a different hammer element;

a plurality of heat conductive elements, each coupled in thermally conductive relationship to a different one of said energizing coils and including fins protruding outwardly from the hammer bank mechanism;

means, including means defining an air flow path, for directing an air flow across the heat conductive elements and transversely to the printing line position; and circuit board means including circuits coupled to said energizing coils, said means defining an air flow path comprising said circuit means and stationary cover means spaced apart therefrom.

3. The invention as set forth in claim 2 above, wherein said energizing coils are disposed along a printing line position and adjacent the top of the hammer bank, wherein the heat conductive elements each include a number of fins disposed to protrude upwardly from the hammer bank, and wherein said means for directing an air flow comprises blower means mounted adjacent the hammer bank,

4. A print hammer assembly comprising:

a hammer bank having a number of substantially vertically disposed hammer elements, each having a free upper end, and a magnetic path structure including a magnetic back plate, a lower permanent magnet and a number of magnetic pole pieces, each disposed in magnetic circuit with the back plate and the free end of a different hammer element;

a plurality of energizing coils, each disposed about a different one of the pole pieces;

a plurality of heat conductive elements each disposed in heat transfer relationship with a different coil and coupled thereto, each extending outwardly from the hammer bank in the vertical direction and having a base portion adjacent the associated coil and multiple fins extending therefrom, said fins being disposed in planes normal to a selected axis; and means for directing air adjacent said hammer bank and substantially parallel to the planes of said fins.

5. The invention as set forth in claim 4 above, wherein said assembly further includes heat conductive epoxy means coupling each of said heat conductive elements to the associated coil, and wherein each of said heat conductive elements includes a concave base surface disposed about and registering with a portion of said associated coil.

6. The invention as set forth in claim 5 above, wherein each of said heat conductive elements includes a base and three vertically extending fin members and each includes means defining a positioning aperture in the base portion thereof, and wherein said assembly further includes bobbin means coupling each coil to its respective pole piece and means fixedly coupling each coil to its associated bobbin means.

7. A print hammer assembly comprising:

a hammer bank having a number of substantially vertically disposed hammer elements, each having a free upper end, magnetic path structure including a magnetic back plate, a lower permanent magnet and a number of magnetic pole pieces, each disposed in magnetic circuit with the back plate and the free end of a different hammer element;

a plurality of energizing coils, each disposed about a different one of the pole pieces;

a plurality of heat conductive elements each disposed in heat transfer relationship with a different coil and coupled thereto, and each extending outwardly from the hammer banks in the vertical direction;

a top housing element disposed adjacent and spaced apart from said heat conductive elements on said hammer bank; and means including said top housing elements and circuit board means adjacent said heat conductive elements for defining a plenum for directing air across the length of said hammer bank in the region between said magnetic cores and said top housing element and substantially transverse relative to said heat conductive elements.

8. A dot matrix print hammer mechanism comprising:

a resilient, elongated print hammer element of magnetic material and a magnetic actuating circuit therefor comprising a generally C-shaped loop and having opposite ends in magentic coupling relation to opposite ends of said print hammer element, and fixedly coupled at one end to said print hammer element, said print hammer element including dot printing means disposed adjacent the free end thereof, said magnetic actuating circuit including permanent magnetic means, the permanent magnet means providing a magnetic bias to tend to maintain the free end of said print hammer element away from a print position, and energizing coil means comprising a substantially cylindrical bobbin and disposed about said magnetic actuating circuit adjacent the free end of said print hammer element for overcoming the magnetic bias under the control of energizing signals;

means coupld in heat transfer relation to said energizing coil means for externally radiating heat generated therein and comprising a heat conductive member including a base having a concave portion in registering relation with a part of the energizing coil means and a plurality of radiating fins extending therefrom in spaced-apart relation, each of the fins having an edge and a pair of opposite broad surfaces joining the edge on opposite sides of the fins; and means for directing a flow of air onto the edges of the radiating fins, the air flowing around the opposite sides of each radiating fin and over the opposite broad surfaces thereof to effect substantial heat transfer with the radiating fins.

9. The invention as set forth in claim 8 above, wherein the opposite broad surfaces of each of said radiating fins are serrated and the radiating fins have a surface area 2.8 times as great as the radiating surface area of said energizing coil.

* * * * *

UNITED STATES PATENT AND TRADEMARK OFFICE

CERTIFICATE OF CORRECTION

PATENT NO. : 4,033,255

DATED : July 5, 1977

INVENTOR(S) : Robert A. Kleist and Jerry Matula

It is certified that error appears in the above-identified patent and that said Letters Patent are hereby corrected as shown below:

Column 1, line 33, after "actuation" and before "every", "of" should read --at--; line 37, before "hammer", "desired" should read --described--. Column 3, line 31, after "comprises" and before "addition", "an" should read --in--. Column 5, line 25, "Gradena" should read --Gardena--. Column 6, line 9, "44°" should read --44° C.--. Column 7, line 18, after "bank", delete the comma (",") and substitute with a period --.--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*